US006848965B2

(12) United States Patent
Wong

(10) Patent No.: US 6,848,965 B2
(45) Date of Patent: Feb. 1, 2005

(54) ANIMATION ACTUATOR AND RELATED DEVICES

(75) Inventor: Sui-Kay Wong, North Point (HK)

(73) Assignee: J.T. Labs, Ltd., Hong Kong (CN)

( * ) Notice: Subject to any disclaimer, the term of this patent is extended or adjusted under 35 U.S.C. 154(b) by 0 days.

(21) Appl. No.: 10/458,824

(22) Filed: Jun. 11, 2003

(65) Prior Publication Data

US 2004/0077260 A1 Apr. 22, 2004

Related U.S. Application Data

(60) Provisional application No. 60/390,252, filed on Jun. 20, 2002.

(51) Int. Cl.[7] ..... A63H 33/38

(52) U.S. Cl. ..... 446/150; 446/175; 40/436

(58) Field of Search ..... 60/527–529; 446/150, 446/484, 147, 491, 175; 40/436, 437, 438

(56) References Cited

U.S. PATENT DOCUMENTS

| | | | | | |
|---|---|---|---|---|---|
| 4,563,876 | A | * | 1/1986 | Banks | 60/527 |
| 4,785,627 | A | * | 11/1988 | Al-Jaroudi | 60/527 |
| 4,965,545 | A | * | 10/1990 | Johnson | 337/140 |
| 5,139,454 | A | * | 8/1992 | Earnest | 446/150 |
| 5,502,463 | A | * | 3/1996 | Sasaki et al. | 345/204 |
| 5,775,524 | A | | 7/1998 | Dunham | |
| 6,104,306 | A | * | 8/2000 | Hogue et al. | 340/686.1 |
| 6,523,285 | B1 | * | 2/2003 | Gilson et al. | 40/124.03 |

* cited by examiner

*Primary Examiner*—Bena Miller
(74) *Attorney, Agent, or Firm*—Kevin J. McGough; Coleman, Sudol, Sapone, P.C.

(57) ABSTRACT

The instant invention relates to an animation actuator and devices employing such an animation actuator. Actuators and devices of the invention are useful in animated entertainment devices. In one embodiment of the instant invention, the actuators are used in connection with an animated greeting card.

15 Claims, 3 Drawing Sheets

ANIMATION ACTUATOR AND RELATED DEVICES

RELATED APPLICATIONS

The instant invention claims priority from U.S. Provisional Patent Application Ser. No. 60/390,252, filed Jun. 20, 2002.

FIELD OF THE INVENTION

The instant invention relates to animation actuators, and devices employing such animation actuators, which are useful in animated entertainment devices. In one embodiment of the instant invention, the actuator is used in connection with an animated greeting card.

BACKGROUND OF THE INVENTION

As electronic articles such as the electronic trading cards ("ETC") illustrated in U.S. Pat. No. 6,200,216 continue to set the standard for entertaining novelty items or greeting cards, there is an increasing demand to improve the animation quality of devices which do not rely upon the transmission of electronic data to convey a message or present an artistic work in an entertaining way. Animated greeting cards, which rely upon a mechanized actuator, are perhaps the most notable of these latter devices. Constraints in existing actuators used in such cards have been the primary reason they have not yet been able to convey a message, or display a character in a way that comes close to approximating the animation quality of articles such as the ETC.

Existing animation actuators suffer from numerous drawbacks: they are fragile; they consume power inefficiently, and they typically can only be used in one particular device configuration. The animated greeting card described in U.S. Pat. No. 5,139,454 ("'454 Patent") illustrates these drawbacks.

The card disclosed in the '454 Patent contains an actuator employing a bimetallic wire about 0.003 to 0.010 inches in diameter. This wire is affixed at one end to a circuit board and at the other to a gear. A Flexinol (Dynalloy) shape memory alloy CVAA") wire is disclosed in the '454 Patent as one example of a useful wire. Upon application of electric current to the wire, the wire contracts thereby exerting a force on the gear which causes the gear to rotate The '454 Patent discloses that a one inch long wire which is 3 millimeters in diameter can be activated by a pulsed current of about 0.75 volts at 6 ohms.

While application of a SMA wire in an actuator such as that disclosed in the '454 Patent has inherent advantages (e.g., as disclosed in detail hereinafter, minimal contraction of a SMA wire can move an attached element a relatively substantial distance), there are numerous drawbacks attendant to the actuator used in the animated greeting card design disclosed in the '454 Patent. It is inherently limited to an open-flap greeting card design and is not readily adaptable to other applications, e.g., a panel display greeting card. It uses small-module size, non-replaceable button batteries. The linear configuration of the SMA wire in the actuator used in the '454 Patent subjects the wire to significant stress, which in turn can either break the wire or limit the movement of the attached moving features. Further, in the actuator illustrated in the '454 Patent, the SMA wire draws a current at a rate that would quickly drain the specified power source. And, in the actuator of the '454 Patent, the wire length is necessarily fairly short, thereby effectively limiting the mechanical force which the wire can convey to the connected gear.

Accordingly, the need exists for versatile animation actuators that are adaptable to numerous animated entertainment devices. Ideally, such actuators will facilitate the efficient use of power, be durable, and be adaptable to numerous configurations. Further, the need exists for animated entertainment devices that employ such actuators to achieve a level of animation approximating that of items such as the ETC.

SUMMARY OF THE INVENTION

The instant invention provides an animation actuator, and an animated entertainment device comprising such animation actuator.

Specifically, an animation actuator of the instant invention comprises a SMA wire which is: (i) affixed at one end to a support and affixed at the other end by a movable element to an elastic return affixed to the support; (ii) disposed for movement on, and in electrical contact with, at least a first electrical conductor and a terminal electrical conductor. The electrical conductor can be nonrotatable, e.g., it can be a metal shaft, round metal post, metal brush, graphite brush (as used in direct current motors) or rotatable, e.g., it can be a rotatable pulley or rotatable electrically conductive sleeve. Where stress on the SMA wire due to prolonged usage is a concern, the SMA wire is disposed for movement on, and is in electrical contact with, at least a first rotatable electrically-conductive pulley and a terminal rotatable electrically conductive pulley or sleeve. The first rotatable electrically-conductive pulley and terminal rotatable electrically conductive pulley are affixed to the support, with the terminal rotatable electrically conductive pulley being positioned between the first rotatable electrically-conductive pulley and the elastic return.

A pulsed electrical current source that provides a source of electric current to the SMA wire through electrical connection to at least the first and terminal electrical conductor is also provided. The pulsed electrical current source can comprise a printed circuit board array (PCBA) having a pulse forming circuit. The PCBA can also comprise circuits that enable the generation by an animated entertainment device of a variety of entertaining sounds or light effects. Upon application of the pulsed electric current to the SMA wire, the SMA wire contracts and moves along said electrical conductors in a direction away from the terminal electrical conductor, thereby exerting tension upon the elastic return and moving the movable element.

An animated entertainment device of the instant invention includes the aforementioned animation actuator. The actuator can be mounted on the back face of a panel, which may take any variety of shapes. The movable element is connected for movement through an aperture in the panel to a first movable element mounted on the front face of the panel for relative movement therewith. Upon application of the pulsed electric current to the SMA wire, the SMA wire contracts and moves along said electrical conductors in a direction away from said terminal electrical conductor, thereby exerting tension upon said elastic return and moving said first movable element and said second movable element.

The strain exerted on the movable elements is relieved in one preferred embodiment of the instant invention by the use of a torque relief coupler, which is described in detail hereinafter. Use of this torque relief coupler lessens the stress exerted on the SMA wire and prolongs the useful life of the actuator. The durability of an actuator of the instant invention makes it particularly well-suited to applications which require prolonged or durable usage such as advertising displays or toys.

As described in detail hereinafter, in embodiments of the instant invention which utilize rotatable electrically conductive pulleys or sleeves, the pulleys or sleeves not only serve as electrical contacts, but also engage the SMA wire during movement in a manner which minimizes the friction and abrasive stress exerted on the wire. This unique SMA wire mounting thereby ensures not only good electrical contact, but also extends the useful life of the SMA wire and hence the operating period of the actuator.

When application of electrical current to the SMA wire is discontinued, it returns to its normal length, relieving tension on elastic return and thereby allowing the movable elements to return to their original positions. When the movable elements are part of a character mounted on the front face of the panel, continuous pulsing of electric current to the SMA wire moves the movable element and hence animates the character.

The animation actuator of the instant invention provides numerous advantages over known actuators used in entertainment devices. For example, the embodiment illustrated in detail hereinafter is less than 2 mm thick, making it ideal for use in applications such as animated greeting cards. It is also essentially noiseless and therefore does not detract from the appeal of audio or visual features. Further, an animation actuator of the instant invention requires minimal power, e.g., it can be powered by a single AAA battery. Such low power usage also makes the animation actuator of the instant invention ideally suited for applications where it is desirable to minimize actuator size.

In the animation actuator of the instant invention, power may be supplied at predetermined intervals to discrete sections of the SMA wire by varying the electric current flow to the electrical conductor, thereby facilitating any variety of motion patterns by interconnected movable elements. Given this feature and the fact that the animation actuator of the instant invention facilitate the use of relatively long segments of SMA wire, the relative movement of the movable elements employed can be cascaded to simulate any number of effects.

DETAILED DESCRIPTION OF THE INVENTION

The following detailed description illustrates a specific application of the actuator of the instant invention, and one particular embodiment of a device of the instant invention incorporating such actuator. It will be appreciated that there are several other animated entertainment devices having a variety of configurations and uses within the scope of the instant invention besides the animated greeting card described hereinafter. Types of such devices include, but are not limited to, advertising displays, home entertainment devices, packaging, animated art work, books, puzzles, toys or office novelty items.

It will also be appreciated that a wide variety of components may be substituted for many of the specific actuator elements illustrated hereinafter. For example, as mentioned, nonrotatable electrical conductors such as metal shaft metal posts, metal post, metal brushes or graphite brushes can be substituted for rotatable electrically conductive pulleys in applications where stress on the SMA wire is not a concern. In another representative example, the elastic return could be an elastic strip or even a rubber band and need not be a metallic spring. Similarly, the animated entertainment device of the instant invention may use, and the animation actuator of the instant invention may actuate, many types of movable elements. For example, known shaft-gear arrangements such as those illustrated in the '454 Patent could be used in animated entertainment devices of the instant invention and could be actuated by the instant invention. And, as discussed hereinafter, in embodiments of the instant invention using a torque limiting coupler to interconnect the movable elements, the torque-limiting coupler may utilize a variety of interconnections to affix the movable element.

Figure 1:
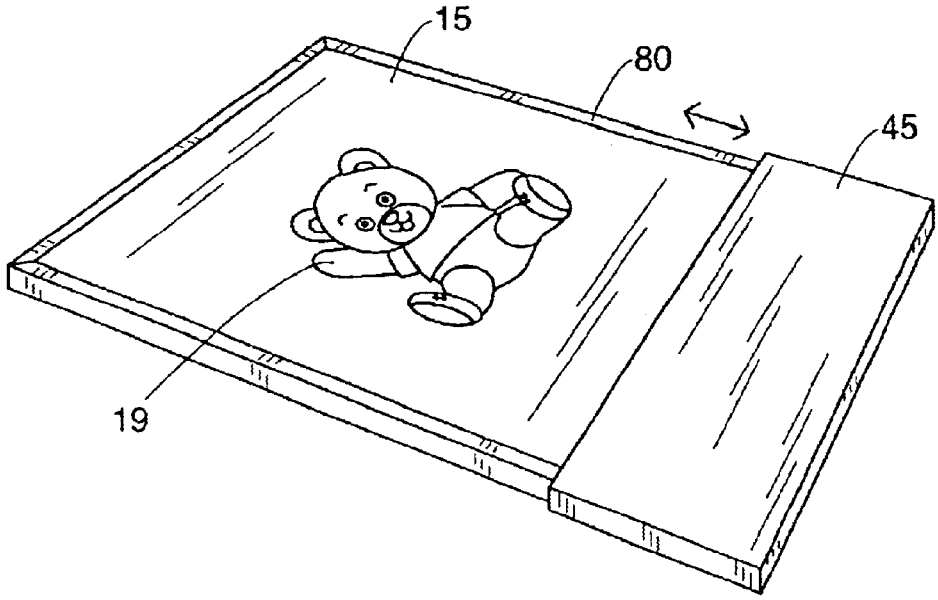
FIG. 1 is a perspective view of a panel greeting card embodiment of the instant invention.

Referring to FIG. 1, an embodiment of the instant invention is illustrated in which the animated entertainment device 80 is in the form of a framed greeting card. The greeting card comprises panel 15 having raised edges; entertainment character 19 is mounted on the front face of panel 15. As described hereinafter, entertainment character 19 is engaged for movement with a movable element (e.g., representing part of the arm of entertainment character 19), which is in turn engaged for movement through an aperture in panel 15 to an actuator affixed to the back face of panel 15, as described in detail hereinafter.

Figure 2:
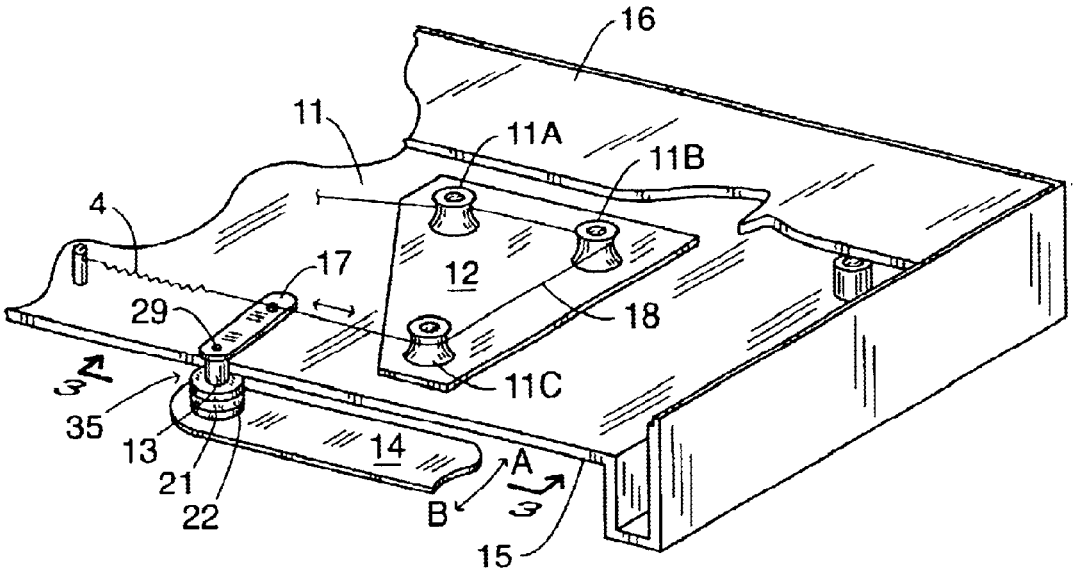
FIG. 2 is a perspective view of actuator of the instant invention used in an animated greeting card.

Referring to FIG. 2, an animation-actuator is mounted on the back face of panel 15, is covered by backing 16, and comprises rotatable electrically conductive pulleys 11 A–C, PCBA 12, SMA wire 18, a movable element in the form of lever 17, an elastic return in the form of spring return means 4, torque-limiting coupling 35 (which is described in detail hereinafter) and movable element 14. Rotatable electrically conductive pulleys 11A–11C are rotatably affixed to, and in electrical contact with, PCBA 12, which in turn is affixed to the back face of panel 15. Rotatable electrically conductive pulleys 11A–11C may be made from any electrically conductive material, e.g., copper. The rotatable electrically conductive pulleys 11A–11C not only conduct electricity to SMA wire 18, they engage the wire in a manner which serves to minimize frictional wear and abrasive stresses as SMA wire 18 moves along the pulleys. Mounting rotatable electrically conductive pulleys 11A–11C on PCBA 12 ensures good electrical contact and minimizes the need for wiring in the actuator.

Where stress on the SMA wire 18 is not a concern (e.g., where the actuator is intended for one-time use in an animated greeting card), SMA wire can be disposed for movement on nonrotatable electrical conductors such as shafts affixed to the PCBA 12. (SMA wire 18 could be held in position on such a nonrotatable conductor in any number of ways, e.g., the SMA wire 18 could be disposed for movement in grooved shafts.)

In the embodiment illustrated in FIG. 2, SMA wire 18 is disposed for movement along rotatable electrically-conductive pulleys 11A–11C and is affixed at one end to PCBA 12 and at the other end to lever 17. SMA wire 18 may be made from any known SMA alloy such as Flexinol or Nitinol. SMA materials exhibit a non-linear relationship between stress and strain when exposed to temperature changes. These alloys undergo a temperature related phase change that allows the SMA to return to any mechanical configuration imposed on the SMA when it is annealed. When the SMA is below its critical temperature, it becomes malleable and may be deformed into any arbitrary shape. Upon heating the SMA above the critical temperature, it undergoes a change in crystal structure and quickly resumes its stiff original shape. Cooling the SMA to below the critical temperature causes it to return it to a cold malleable condition. The best-known SMA is Nitinol, a titanium nickel alloy. With a temperature change of as little as 18° F., Nitinol can exert a force of as much as 60,000 psi against a deformation resistance. Pulsing electric current to a SMA wire can cause it to selectively contract and return to normal length in millions of cycles with little change in performance.

PCBA 12 may comprise any suitable printed circuit board containing a pulse-forming circuit capable of applying a pulsed electrical signal to SMA wire 18. PCBA 12 may also contain circuitry which creates, through known designs, various sounds (including music and voice simulations) and lighting features, thereby enhancing the appeal of an animated entertainment device of the instant invention.

If desired, more than three electrical conductors may be employed in the device of the instant invention, and, as explained hereinafter, the configuration of such an actuator may be optimized with respect to the exact placement and nature of the movable feature(s) used and the type of electrical connection between the electrically conductor and PCBA 12. Lever 17 is in turn engaged at one end for lateral movement to return spring means 4, which is affixed to the back face of panel 15, and is rotatably affixed at the other end to the non-headed end of headed pin 29. Return spring means 4 may be a metallic spring or may be comprised of a non-metallic elastic material. Headed pin 29 is part of torque-limiting coupler 35, the details of which are as follows.

Figure 3:
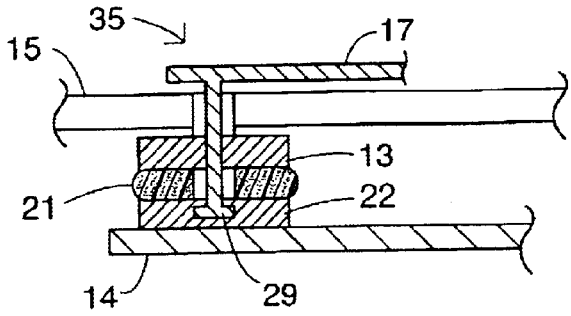
FIG. 3 is a side view of a torque-limiting coupling employed as part of actuator of the instant invention.

Referring to FIG. 3, torque-limiting coupler 35 includes driven disc 22, which is affixed adhesively at its top side to the back face of movable element 14. Driving disc 13 is positioned between the front face of panel 15 and the bottom side of driven disc 22. Washer 21 is turn positioned between the bottom side of driven disc 22 and the top side of driving disc 13. Headed pin 29 extends axially through a cylindrical aperture in panel 15, and frictionally engages lever 17, the front face of panel 15, driving disc 13, washer 21, and driven disc 22. The headed end of headed pin 29 terminates within driven disc 22 and a compressive force is thereby exerted by both driving disc 13 and driven disc 22 on, respectively, the top and bottom faces of washer 21.

The configuration of torque-limiting coupler 35 minimizes and relieves the strain exerted on the movable element 14 during operation of the animated actuator Driven disc 22 is engaged to movable element 14 in any number of ways, e.g. by adhesives, melding, Velcro, snap-on means or by magnetic attraction. It will be appreciated that torque-limiting coupler 35 may engage both lever 17 and driving disc 13 and will also facilitate strain relief coupling between lever 17 and the movable element 14 as a result of torque-limiting coupling.

Figure 4:
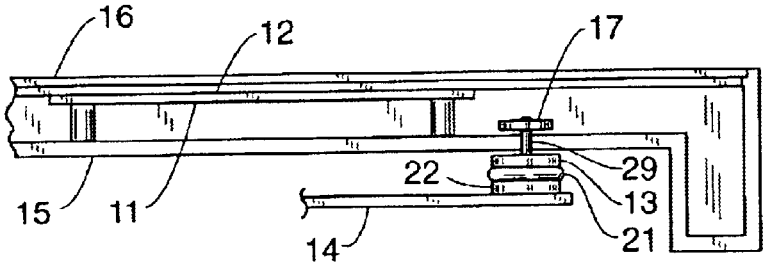
FIG. 4 is a top view of a panel greeting card embodiment of the instant invention that illustrates the positioning of various elements of the actuator relative to the panel front and back face and backing.

A top view of the orientation of the actuator relative to panel 15 and backing 16 is illustrated in FIG. 4. More specifically, the positioning of one of the rotatable electrically conductive pulleys 11A–11C, PCBA 12, lever 17, movable element 14, and components of torque-limiting coupling including driving disc 13 relative to the front and back faces of panel 15 and backing 16 is shown in FIG. 4.

Figure 5:
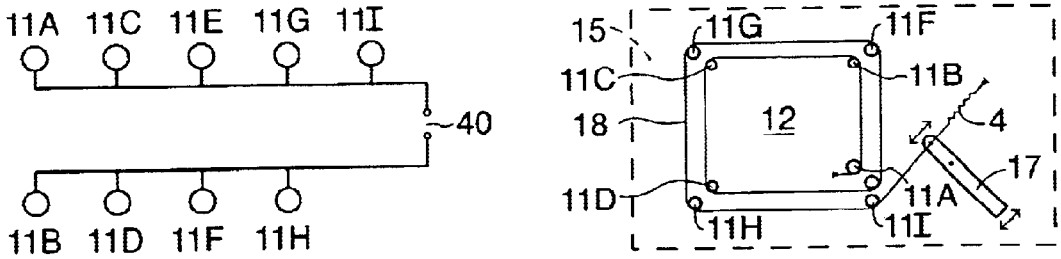
FIG. 5 is a plan view of the electrical connection to a power source of rotatable electrically conductive pulleys used in the actuator of the instant invention.

FIG. 5 illustrates one example of the several electrical connections possible between electrical conductors such as rotatable electrically conductive pulleys 11A–11I and PCBA 12. Power source (voltage/current source) 40 may be any electric power source used in small devices, e.g. batteries such AAA batteries. For example, power source 40 could consist of one or more changeable or rechargeable batteries mounted on the back face of panel 15 in a manner convenient for insertion or replacement. Alternatively, if in an application power (voltage/current) is drawn continuously by the animation actuator of the instant invention (e.g., if the animation actuator is used in an advertising display), it could prove useful to use an appropriate connection to a source of electrical current through a wall jack. Power source 40 could also be a solar cell. In FIG. 5, alternate rotatable electrically conductive pulleys 11A–11I are connected in parallel to Power Source 40.

Referring to FIG. 5, through an integrated-circuit timing device incorporated into PCBA 12, pulsed electric current can flow to discrete segments of SMA wire 18 (e.g., the segment of SMA wire 18 defined by 11A-IIB) at predetermined intervals. Direct mounting of rotatable electrically conductive pulleys 11A–11I onto PCBA 12 ensures optimum electrical contact and avoids the need for additional wire contact between these elements. Further, as illustrated in FIG. 5, a plurality of rotatable electrically conductive pulleys 11A–11I on PCBA 12 may be electrically connected in a configuration where alternative contacts (e.g., 11A and 11B) are connected in parallel to an electrical power source 40. In the configuration shown in FIG. 5, and as explained in the following description of the operation of the illustrated embodiment, maximum displacement of SMA wire 18 will be achieved when current flows in parallel through all electrically conductive means such as rotatable pulleys i.e., in FIG. 5, through 11A–11I.

The advantages attendant to pulsing electrical current selectively to segments of SMA wire 18, through various of the rotatable electrically conductive means such as rotatable pulleys 11A–11I include improved regulation of the motion of SMA wire 18, and improved control over the movement of associated movable elements such as movable element 17 connected to return spring means 4.

Figure 6:
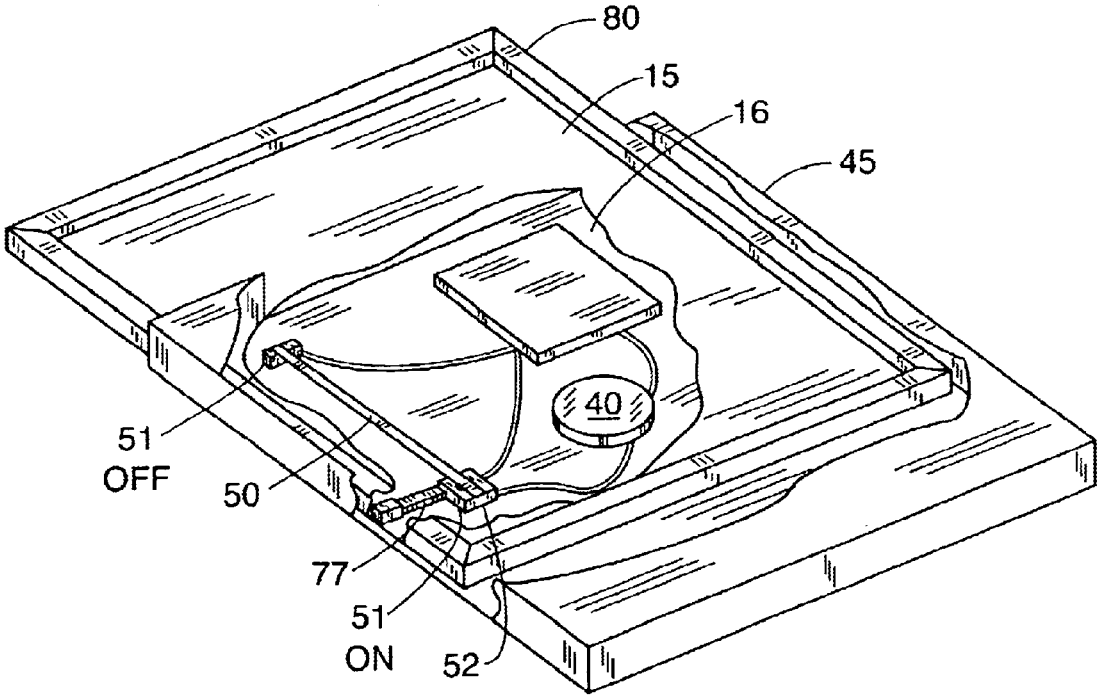
FIG. 6 is a perspective view of an embodiment of the instant invention in which an greeting card is initially disposed within, and then pulled from, a sleeve.

Power source 40 may be connected to PCBA 12 through a variety of switches. A slideable switch useful in an embodiment of the instant invention wherein the animated entertainment device is disposed within, and the pulled from, a sleeve 45 is depicted in FIG. 6 and is described hereinafter.

Referring again to FIG. 2, pulsed electric current can flow to rotatable electrically conductive pulleys 11A–11C through an IC timer in PCBA 12 connected to a power source. This pulsed electrical current in turn flows through rotatable electrically conductive pulleys 11A–11C to SMA wire 18 and SMA wire 18 thereby contracts. The tension resulting from this electrically-induced contraction of SMA wire 18 moves SMA 18 along electrically conductive pulleys 11A–11C in the direction towards 11A, thereby moving lever 17 laterally and exerting tension on spring return means 4. The force associated with the lateral movement of lever 17 is in turn translated to rotate headed pin 29, which thereby rotates driving disc 13. Rotation of driving disc 13 in turn rotates washer 21 and driven disc 22.

Referring to FIGS. 2 and 3, the torque transmitted between the driving disc 13 and the driven disc 22 is limited by the friction resulting from the compressive engagement of washer 21 and driving disc 13. Rotation of driven disc 22 in turn rotates movable element 14 from a first position "A" to a second position "B", as shown in FIG. 2. When the pulsed electric current is not applied to the SMA wire 18, the wire expands to its original length, relieving tension on spring return means 4 and thereby returning movable element 14 to its original position "A".

The relative efficiency of the actuator of the instant invention is demonstrated by calculating the movement of movable element 14 relative to the contraction of the SMA wire 18 and length of lever 17. The following equation defines approximately the interrelationship of these values:

$$M=D\times R/r$$

where M is the distance moved by movable means such as lever 17, D is the length of contraction of the SMA wire 18, R is the length of movable element 14 and r is the length of movable means such as lever 17. For example, where SMA wire 18 is 2" long and contracts 3% upon application of electric current, lever 17 is 4 mm in length, and movable element 14 is 80 mm in length, the movement of movable element 14 can be calculated as follows:

$$M=(0.03)\times(2.0")\times 80\text{ mm}/4\text{ mm}=1.2"$$

The movement of movable element 14 can thereby replicate any number of gestures by a character mounted on the front face of panel 15. For example, movable element 14 could be shaped as an arm and be attached for movement with a character like character 19 of FIG. 1, such that movement of movable element 14 simulates waving by the character.

Referring to FIG. 6, an embodiment of the instant invention is illustrated in which animated entertainment device 80 is initially disposed within, and then pulled outwardly from, sleeve 45. Animated entertainment device 80 comprises backing 16 covering the back face of panel 15. A switch is affixed to the back face of panel 15 and is comprised of strip 50 in panel 15, first contact means 51, and second contact means 52. As shown in FIG. 6, first contact means 51 is disposed for movement within strip 50 and second contact means 52 is affixed to the back face of panel 15 at one end of strip 50. Arm 77 is affixed to the inside of sleeve 45 and extends perpendicularly to strip 50 to engage first contact 51. When the animated entertainment device 80 is pulled outwardly from sleeve 45, arm 77 engages first contact 51 and slides first contact 51 into electrical contact with second contact 52, thereby moving the switch into an "on" position, which causes electrical current to flow from a power source 40. When the animated entertainment device is thereafter returned to sleeve 45, arm 77 again engages first contact 51 and moves first contact 51 out of electric contact with second contact 52, thereby moving the switch into an "off" position and discontinuing the flow of electric current from power source 40.

Figure 7:
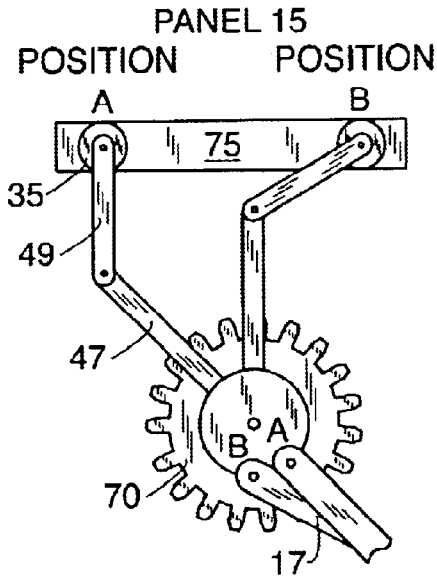
FIG. 7 is a plan view of a shaft-gear arrangement useful in an actuator used in a greeting card embodiment of the instant invention.

Referring to FIG. 7, lever 17 is engaged for movement through gear 70 with the bottom end of first shaft 47. The top end of first shaft 47 is in turn pivotally engaged to the bottom end of second shaft 49. The top end of second shaft 49 is in turn engaged through torque-limiting coupling 35 to a movable feature in a manner such as the connection of movable feature 14, lever 17 and torque-limiting coupling 35 previously described herein with reference to FIG. 2 and FIG. 3. However, in the embodiment illustrated in FIG. 7, torque-limiting coupling 35 is disposed for movement along slot 75 in panel 15. A force associated with the lateral movement of lever 17 is in turn translated first to first shaft 47 through gear 70. First shaft 47 in turn pivotally engages second shaft 49, which in turn moves torque-limiting coupling 35 from a first position "A" to a second position "B", as shown in FIG. 7.

It will be appreciated that there are many possible configurations of animation actuators of the instant invention and many possible applications of those actuators other than the illustrated greeting card application. The illustrations herein are in no way intended to be limiting with respect to the scope of the instant invention. Further, there are many possible interconnections between the various elements of the actuator of the instant invention, e.g., lever 17, moveable element 14, and that the interconnections described herein are merely illustrative and are not limiting in any regard. For example, two or more movable elements mounted on the front face of panel 15 may be engaged for movement, e.g., through gears or springs and may be connected to elongated arms and shafts.

What is claimed is:

1. An animated entertainment device comprising:

an animation actuator mounted on a back face of a panel, said actuator comprising a first movable element mounted for movement thereon, said first movable element being connected for movement through an aperture in the panel to a second movable element mounted on a front face of the panel for relative movement therewith, the actuator further including a SMA wire which is: (i) affixed at one end to the back face of the panel and affixed at another other end by the first movable element to an elastic return affixed to the back face of the panel (ii) disposed for movement on, and in electrical contact with, electrical conductors comprising at least a first electrical conductor and a terminal electrical conductor, wherein said first and terminal electrical conductors are affixed to the back face of the panel, and said terminal electrical conductor is positioned between said first electrical conductor and said elastic return, and (iii) in electrical connection through the first and terminal electrical conductors to a source of pulsed electrical current, wherein, upon application of pulsed electric current to the SMA wire, the SMA wire contracts and moves along said electrical conductors in a direction away from said terminal electrical conductor, thereby exerting tension upon said elastic return and moving said first movable element, which in turn moves said second movable element.

2. The device of claim 1, wherein the electrical conductors are rotatable, electrically conductive pulleys.

3. The device of claim 2, wherein the SMA wire is disposed for movement on three or more rotatable, electrically conductive pulleys, and the pulsed electric current is applied to the SMA wire by a pulse-forming circuit which is contained within a printed circuit board array (PCBA) and: (i) which is mounted on the back face of the panel (ii) connects a power source to at least two of the rotatable electrically conductive pulleys, and (iii) is programmed to pulse electrical current to the rotatable electrically conductive pulleys.

4. The device of claim 3, wherein: (1) the SMA wire is connected at one end to the printed circuit board array (PCBA) and is connected at the other end to the first movable element, and (2) the rotatable, electrically conductive pulleys are rotatably affixed to the printed circuit board array (PCBA).

5. The device of claim 3, wherein the power source is activated by a switch mounted on the back face of the panel.

6. The device of claim 5, wherein: (a) the device is disposed for movement within a walled housing; (b) the housing has a protuberance which, when the device is disposed within the housing, extends from the inside of a housing wall above the back face of the panel to contact the switch; and (c) wherein, upon retraction of the device from the housing, the protuberance moves the switch from an off position to an on position, thereby causing pulsed electric current to flow to the SMA, and wherein upon reinsertion of the device to the housing, the protuberance moves the switch from an on position to an off position, thereby discontinuing the flow of pulsed electric current to the SMA.

7. The device of claim 3, wherein the power source is connected in parallel to two or more rotatable electrically conductive pulleys.

8. The device of claim 3, wherein the power source is a rechargeable or disposable battery.

9. The device of claim 1, wherein the electrical conductors are metal shafts, metal posts, metal brushes, or graphite brushes.

10. The device of claim 1, wherein the first movable element is connected to the second movable element by a torque limiting coupler.

11. The device of claim 1, wherein the panel has raised edges which define a frame and further comprises a backing which is affixed to the raised edges and positioned above the back face of the panel.

12. The device of claim 1, wherein the device is a greeting card.

13. The device of claim 1, wherein the SMA wire is disposed for movement on two or more electrical conductors, and the pulsed electric current is applied to the SMA wire by a pulse-forming circuit contained within a printed circuit board array (PCBA).

14. The device of claim 13, wherein the power source is activated by a switch mounted on the back face of the panel.

15. The device of claim 14, wherein:

(a) the device is disposed for movement within a housing;

(b) the housing has a protuberance which, when the device is disposed within the housing, extends from the inside of the housing wall above the back face of the panel to contact the switch; and (c) wherein, upon retraction of the device from the housing, the protuberance moves the switch from an off position to an on position causing pulsed electric current to flow to the SMA, and upon reinserting the device to the housing, the protuberance moves the switch from an on position to an off position, thereby -discontinuing the flow of pulsed electric current to the SMA.

* * * * *